US011204218B1

(12) United States Patent
Wei

(10) Patent No.: US 11,204,218 B1
(45) Date of Patent: Dec. 21, 2021

(54) TOY GUN WITH FIXED FIRING PIN STRUCTURE MECHANISM

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 5 days.

(21) Appl. No.: 16/900,459

(22) Filed: Jun. 12, 2020

(51) Int. Cl.
*F41B 11/00* (2013.01)
*F41B 11/723* (2013.01)
*F41B 11/89* (2013.01)
*F41B 11/62* (2013.01)

(52) U.S. Cl.
CPC ..... *F41B 11/723* (2013.01); *F41B 11/89* (2013.01); *F41B 11/62* (2013.01)

(58) Field of Classification Search
CPC ..... F41B 11/62; F41B 11/72; F41B 11/721; F41B 11/723; F41B 11/89
USPC ..... 124/56, 71, 73, 74, 76
See application file for complete search history.

(56) References Cited

U.S. PATENT DOCUMENTS 3,782,359 A * 1/1974 Kester ..... F41B 11/62 124/48
5,339,791 A * 8/1994 Sullivan ..... F41B 11/00 124/73
5,341,790 A * 8/1994 Ebert ..... F41B 11/62 124/69
6,003,504 A * 12/1999 Rice ..... F41B 11/52 124/73
7,237,545 B2 * 7/2007 Masse ..... F41B 11/73 124/75
7,712,463 B2 * 5/2010 Quinn ..... F41B 11/721 124/73
7,770,571 B2 * 8/2010 Tippmann, Jr ..... F41B 11/00 124/73
7,886,731 B2 * 2/2011 Masse ..... F41B 11/721 124/73
8,074,632 B2 * 12/2011 Dobbins ..... F41B 11/721 124/77
10,393,472 B1 * 8/2019 Wei ..... F41B 11/723
10,852,098 B1 * 12/2020 Wei ..... F41B 11/723
2003/0047175 A1 * 3/2003 Farrell ..... F41B 11/52 124/76
2003/0094167 A1 * 5/2003 Nibecker, Jr. ..... F41B 11/683 124/64
2006/0027221 A1 * 2/2006 Farrell ..... F41B 11/723 124/31
2011/0146647 A1 * 6/2011 Hu ..... F41B 11/723 124/76
2015/0053194 A1 * 2/2015 Li ..... F41B 11/683 124/69

* cited by examiner

*Primary Examiner* — Alexander R Niconovich
(74) *Attorney, Agent, or Firm* — Chun-Ming Shih; HDLS IPR Services

(57) ABSTRACT

A toy gun with a fixed firing pin structure mechanism includes a gun body having a barrel and a pneumatic conduit connected thereto; a switch valve installed between the barrel and the pneumatic conduit; an action assembly installed on the barrel; the action assembly having an action with a piston member and moving relative to the gun body, a restoring spring assembly supported therebetween; the restoring spring assembly driving the action toward the barrel; and a firing pin structure fixed onto the gun body and arranged between the switch valve and the piston member; the firing pin structure having a piston seat and a firing pin penetrating therein and moving relative to the switch valve; the piston member engaging/disengaging the piston seat.

11 Claims, 16 Drawing Sheets

TOY GUN WITH FIXED FIRING PIN STRUCTURE MECHANISM

BACKGROUND OF THE INVENTION

Field of the Invention

The technical field relates to a toy gun structure, and in particular, to a toy gun with a fixed firing pin structure mechanism.

Description of Related Art

As modern people, nowadays, tend to have busy schedule and certain level of working stress, a lot of people choose to perform recreation activities to relieve stress accumulated. In addition, the population seeking new and exciting recreation activities is increasing, and toy guns, such as BB gun, paintball gun, air gun etc., have become one of the key tools for shooting training performed by people in recent years.

The firing pin structure of a traditional toy gun is fixed onto the action and moves horizontally along with the action. In addition, the air pressure is released from the gas cylinder to push the action in order to drive the firing pin structure to retreat. Once the action is retreated, the spring is compressed. When the spring is restored, it then pushes the action and the firing pin structure to move forward again and the hammer is released. The hammer then strikes the firing pin structure and the valve. Accordingly, when such process is repeated, it is able to achieve the so-called running fire mode.

However, the stroke of the spring of a small toy gun is relatively shorter and the elasticity is also softer, such that the speed and position of the spring restoration cannot be controlled easily. Consequently, when the action moves forward and backward horizontally, the spring is likely to have fatigue such that the force exertion on the action becomes insufficient. As a result, the action cannot drive the firing pin to the predefined firing position, causing the running fire mode to be interrupted.

In view of above, the inventor seeks to improve and overcome the aforementioned drawback associated with the currently existing technology after years of research and development along with the utilization of academic theories in order to achieve a reasonable design of the present invention capable of effectively overcoming the aforementioned drawbacks.

SUMMARY OF THE INVENTION

The present invention provides a toy gun with a fixed firing pin structure mechanism, utilizing a firing pin structure directly fixed onto a gun body in order to prevent the situation where the firing pin structure fails to move to the predefined location, thereby achieving the merit of smooth continuous firing of the toy gun of the present invention.

In an exemplary embodiment of the present invention, the present invention provides a toy gun with a fixed firing pin structure mechanism, comprising: a gun body having a barrel and a pneumatic conduit connected to the barrel; a switch valve installed between the barrel and the pneumatic conduit; an action assembly installed on the barrel; the action assembly comprising an action configured to move forward and backward horizontally relative to the gun body, a restoring spring assembly elastically supported between the gun body and the action; the restoring spring assembly configured to drive the action to restore in a direction approaching the barrel; the action having a piston member; and a firing pin structure fixed onto the gun body and arranged between the switch valve and the piston member; the firing pin structure comprising a piston seat and a firing pin penetrating into the piston seat and configured to move forward and backward horizontally relative to the switch valve; the piston member configured to fill into or disengage from the piston seat.

In view of the above, in the present invention, the firing pin structure is directly fixed onto the gun body in order to prevent the situation where the firing pin structure fails to move to the predefined location, and the piston member is required to be filled into the piston seat in order to perform firing, thereby achieving the merits of smooth continuous firing and high safety of use of the toy gun of the present invention.

DETAILED DESCRIPTION OF THE INVENTION

Figure 1:
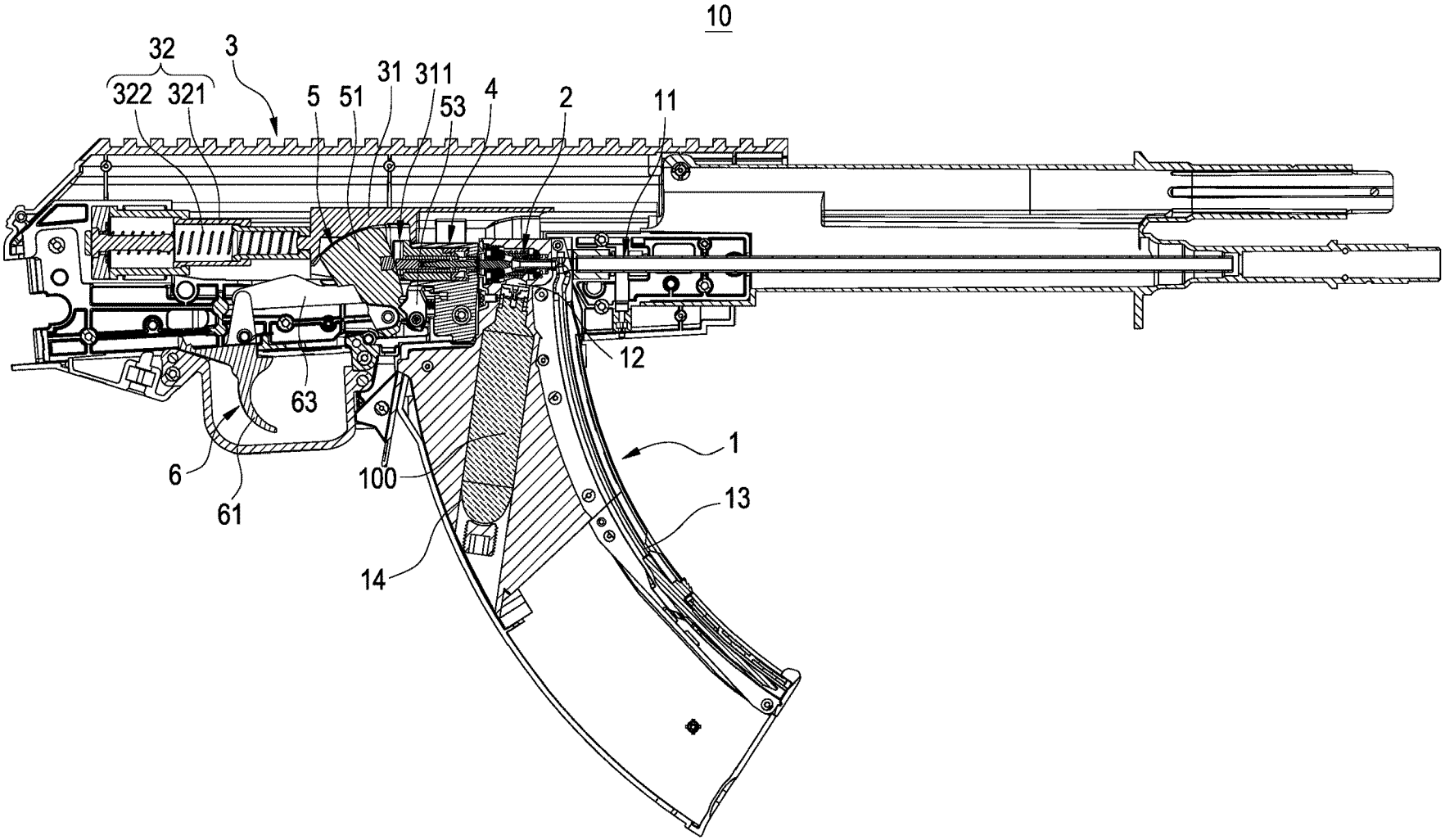
FIG. 1 is a cross sectional view of the toy gun of the present invention.

The following provides a detailed technical content of the present invention along with the accompanied drawings. However, it shall be understood that the accompanied drawings are provided for reference and illustration purposes only such that they shall not be used to limit the scope of the present invention.

As shown in FIG. 1 to FIG. 16, the present invention provides a toy guy with a fixed firing pin structure mechanism. The toy gun 10 mainly comprises a gun body 1, a switch valve 2, an action assembly 3 and a firing pin structure 4.

Figure 2:
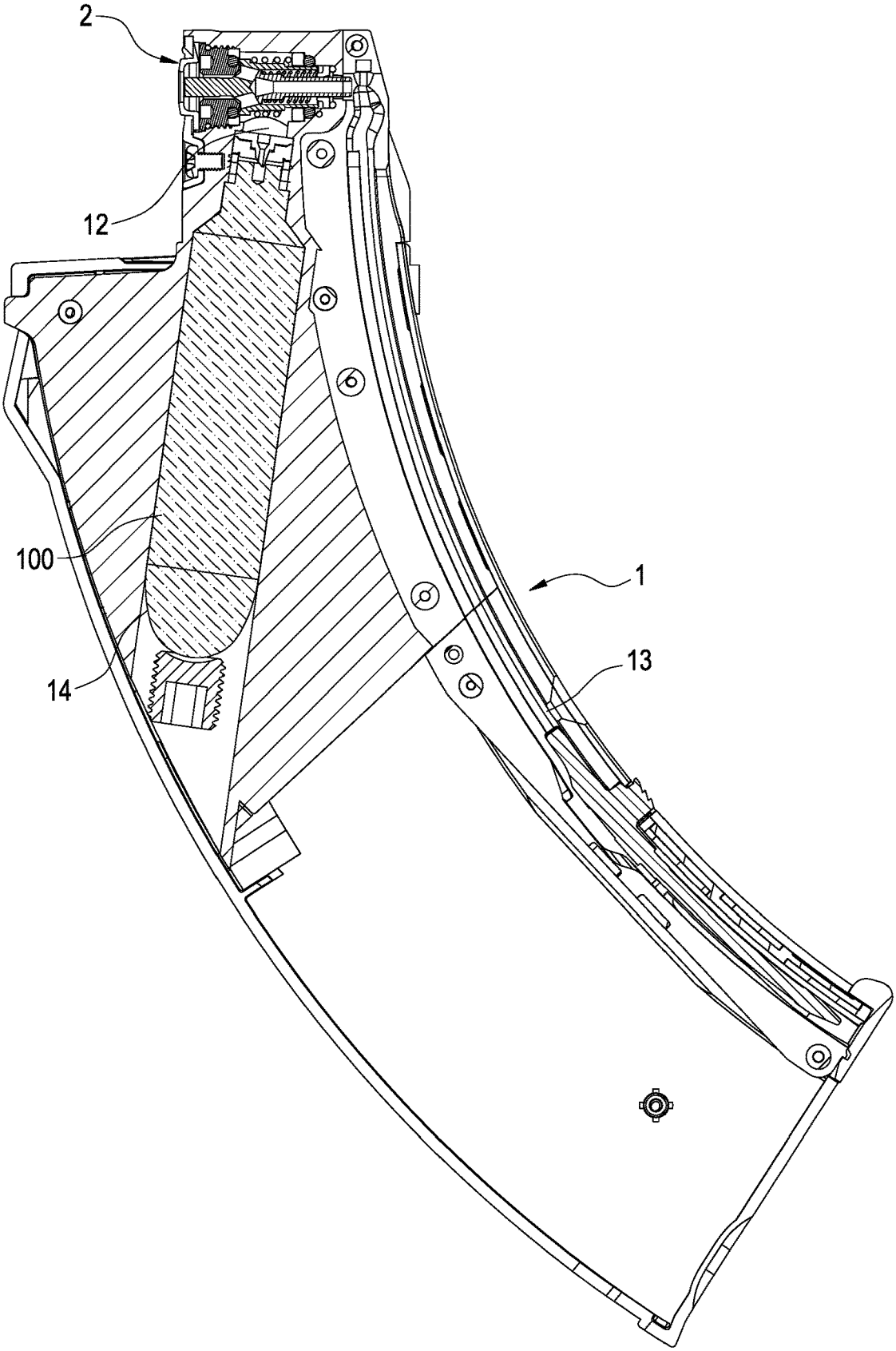
FIG. 2 is a partial cross-sectional view of the toy gun of the present invention.

As shown in FIG. 1 to FIG. 2, the gun body 1 includes a barrel 11, a pneumatic conduit 12 connected to the barrel 11, ballistics 13 and one or a plurality of gas cylinder chambers 14 installed at a rear end of the pneumatic conduit 12. A gas cylinder 100 is placed inside the gas cylinder chamber 14. A bullet (not shown in the drawings) is loaded into the barrel 11 from the ballistics 13. In addition, the gas cylinder 100 placed inside the gas cylinder chamber 14 has been pierced to allow the internal gas of the gas cylinder 100 to flow outward and to fill up the internal of the pneumatic conduit 12.

As shown in FIG. 1 to FIG. 2, the switch valve 2 is installed between the barrel 11 and the pneumatic conduit 12. The switch valve 2 is used to control the connection or isolation between the barrel 11 and the pneumatic conduit 12.

Figure 3:
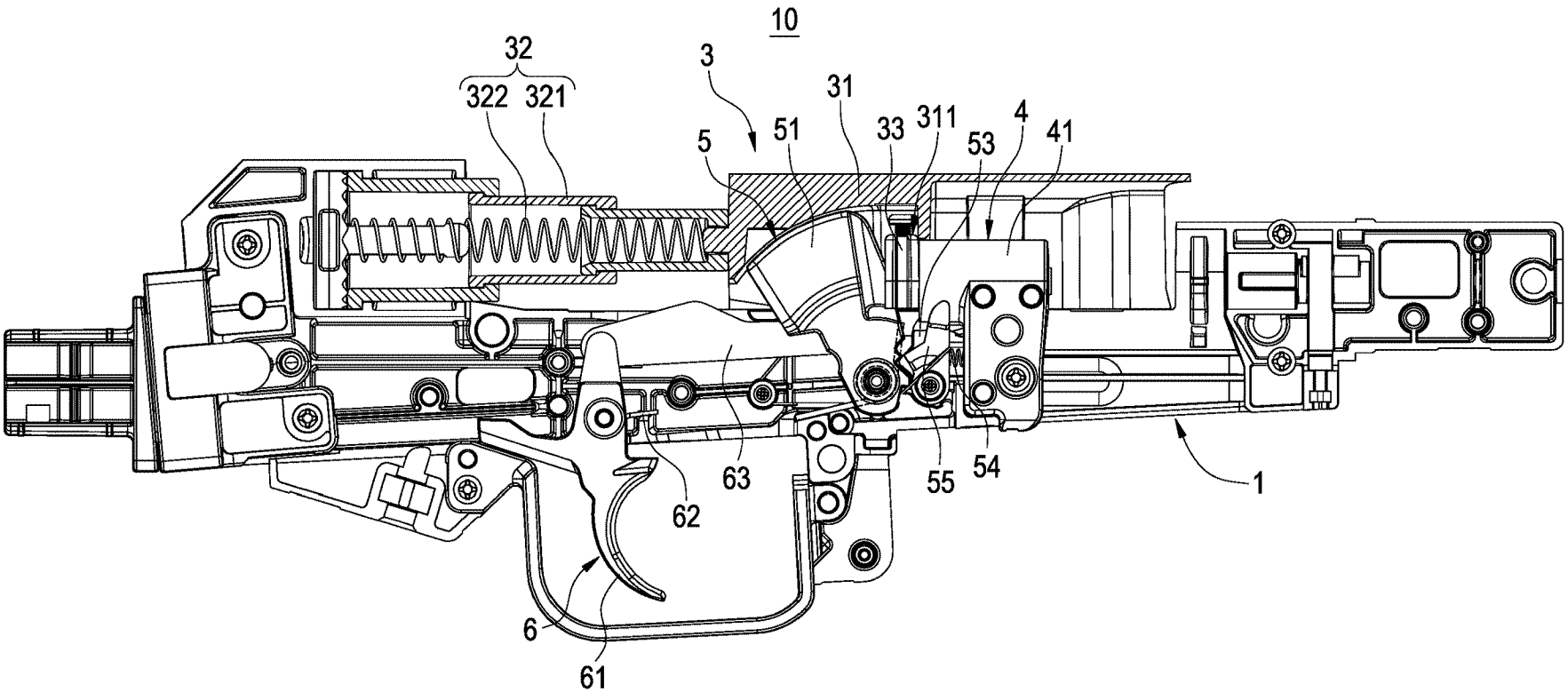
FIG. 3 is another partial cross-sectional view of the toy gun of the present invention.
Figure 4:
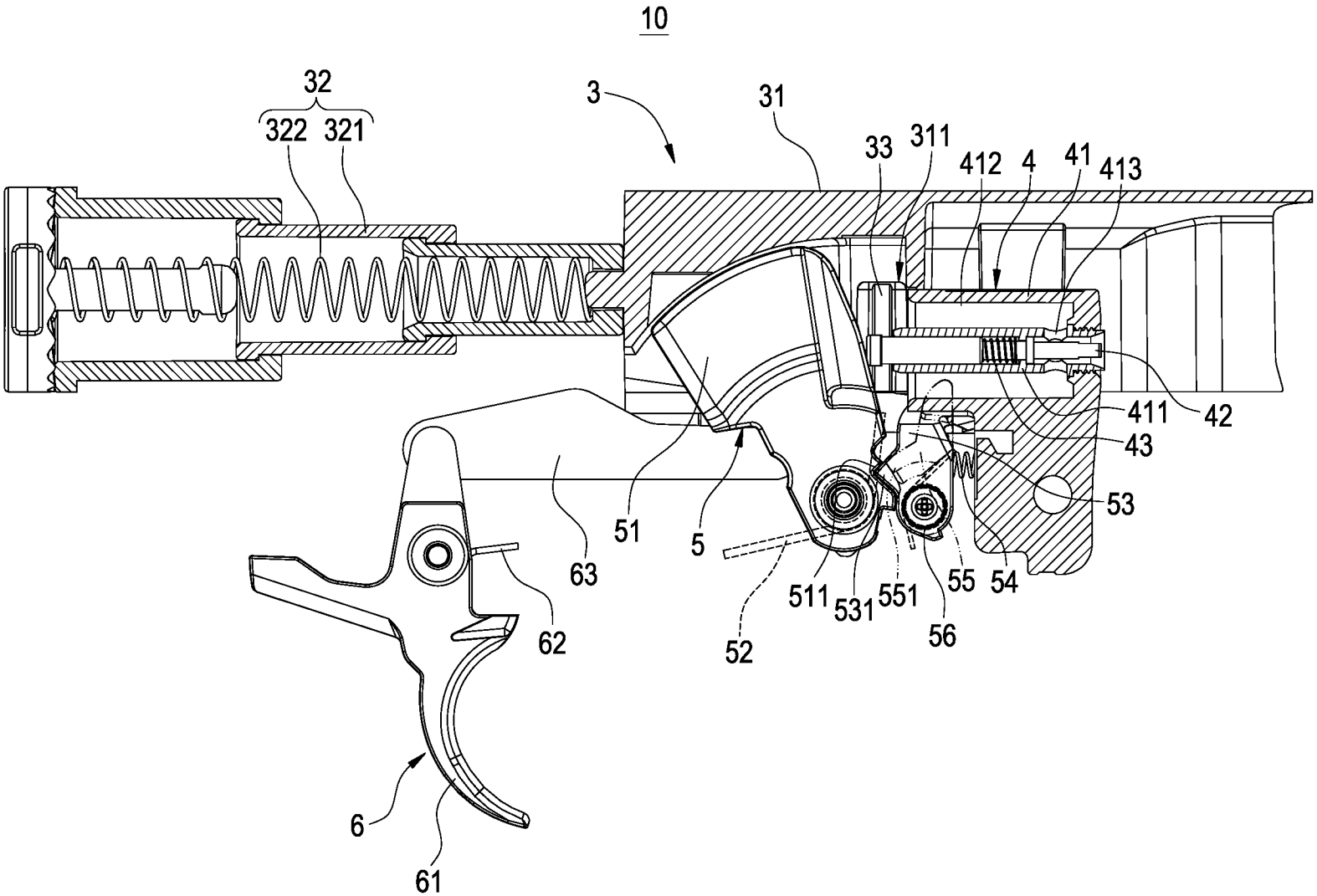
FIG. 4 is a first state of use view of the toy gun of the present invention.

As shown in FIG. 1, FIG. 3 to FIG. 4, the action assembly 3 is installed on the gun body 1. The action assembly 3 comprises an action 31 configured to move forward and backward horizontally relative to the gun body 1, a restoring spring assembly 32 elastically supported between the gun body 1 and the action 31. The restoring spring assembly 32 drives the action 31 to restore in a direction approaching the barrel 11. The action 31 includes a piston member 311, and the piston member 311 is a hollow piston 33 fixed onto the action 31.

In addition, the restoring spring assembly 32 comprises a plurality of shell housings 321 installed between the gun body 1 and the action 31 and configured to penetrate through each other and a helical spring 322 received at an internal of the plurality of shell housings 321.

As shown in FIG. 1, FIG. 3 to FIG. 4, the firing pin structure 4 is fixed onto the gun body 1 and arranged between the switch valve 2 and the piston member 311. The firing pin structure 4 comprises a piston seat 41 and a firing pin 42 penetrating into the piston seat 41 and is able to move forward and backward horizontally relative to the switch valve 2. The piston member 311 is able to fill into or disengage from the piston seat 41.

Please refer to the following detailed description, the firing pin structure 4 further comprises a first restoring spring 43. The piston seat 41 is fixed onto the gun body 1. The piston seat 41 includes a sleeve 411 and a ring slot 412 circumferencing a perimeter of the sleeve 411. The sleeve 411 includes one or a plurality of ventilation holes 413 connected to the ring slot 412. The firing pin 42 penetrates into the sleeve 411 and is able to move forward and backward horizontally relative to the sleeve 411. The first restoring spring 43 is elastically supported between the sleeve 411 and the firing pin 42 and is able to drive the firing pin 42 to restore in a direction away from the switch valve 2. The hollow piston 33 is able to fill into or disengage from the ring slot 412. In addition, when the hollow piston 33 is filled into the ring slot 412, a rear end of the firing pin 42 is exposed at an external of the hollow piston 33.

As shown in FIG. 1, FIG. 3 to FIG. 4, the toy gun 10 of the present invention further comprises a hammer assembly 5. The hammer assembly 5 comprises a hammer 51 pivotally attached onto the gun body 1 and a second restoring spring 52 elastically supported between the gun body 1 and the hammer 51. The second restoring spring 52 is able to drive the hammer 51 to restore in a direction toward a position for striking the firing pin 42. When the hammer 51 strikes the firing pin 42, the firing pin 42 is driven to press the switch valve 2.

In addition, the hammer assembly 5 further comprises a hammer latch 53 pivotally attached onto the gun body 1 and a third restoring spring 54 elastically supported between the gun body 1 and the hammer latch 53. The third restoring spring 54 is able to drive the hammer latch 53 to restore in a direction approaching the hammer 51.

Furthermore, the hammer assembly 5 further comprises a running fire latch 55 pivotally attached onto the gun body 1 and a fourth restoring spring 56 elastically supported between the gun body 1 and the running fire latch 55. The fourth restoring spring 56 is able to drive the running fire latch 55 to restore in a direction toward a position for latching the hammer 51.

Moreover, when the piston member 311 moves in a direction approaching the piston seat 41 and is located between the piston seat 41 and the hammer 51, the action 31 is able to press the running fire latch 55 in order to allow the running fire latch 55 to release the hammer 51.

In addition, the hammer latch 53 and the running fire latch 55 are pivotally attached onto the gun body 1 in a left and right parallel arrangement method. The hammer latch 53 includes a first protrusion 531. The running fire latch 55 includes a second protrusion 551. The hammer 51 includes a notch 511. The first protrusion 531 and the second protrusion 551 are able to engage with or disengage from the notch 511, thereby allowing the hammer latch 53 and the running fire latch 55 to latch or release the hammer 51.

Furthermore, since the hammer latch 53 and the running fire latch 55 are pivotally attached onto identical location of the gun body 1 in the left and right parallel arrangement method, and since the first protrusion 531 and the second protrusion 551 also share one identical notch 511, the gun body 1 is not required to have a pivotal attachment structure, and the hammer 51 is not required to have other notches formed thereon. Consequently, the effect of simplified components and structure can be achieved.

As shown in FIG. 1, FIG. 3 to FIG. 4, the toy gun 10 of the present invention further comprises a trigger assembly 6. The trigger assembly 6 is able to press or release the hammer latch 53. When the trigger assembly 6 presses the hammer latch 53, the hammer latch 53 is driven to release the hammer 51.

Please refer to the following detailed description. The trigger assembly 6 comprises a trigger 61 pivotally attached onto the gun body 1, a fifth restoring spring 62 elastically supported between the gun body 1 and the trigger 61 and a trigger linkage rod 53 pivotally attached onto the trigger 61. The trigger 61 is able to move between a ready-to-fire position and a fire-completed position. The fifth restoring spring 62 is able to drive the trigger 61 to restore in a direction toward the ready-to-fire position.

Furthermore, the trigger linkage rod 63 is able to press or release the hammer latch 53. When the trigger 61 is at the ready-to-fire position, the trigger linkage rod releases the hammer latch 53. When the trigger 61 is at the fire-completed position, the trigger linkage rod 63 is driven to press the hammer latch 53 in order to allow the hammer latch 53 to release the hammer 51.

Figure 5:
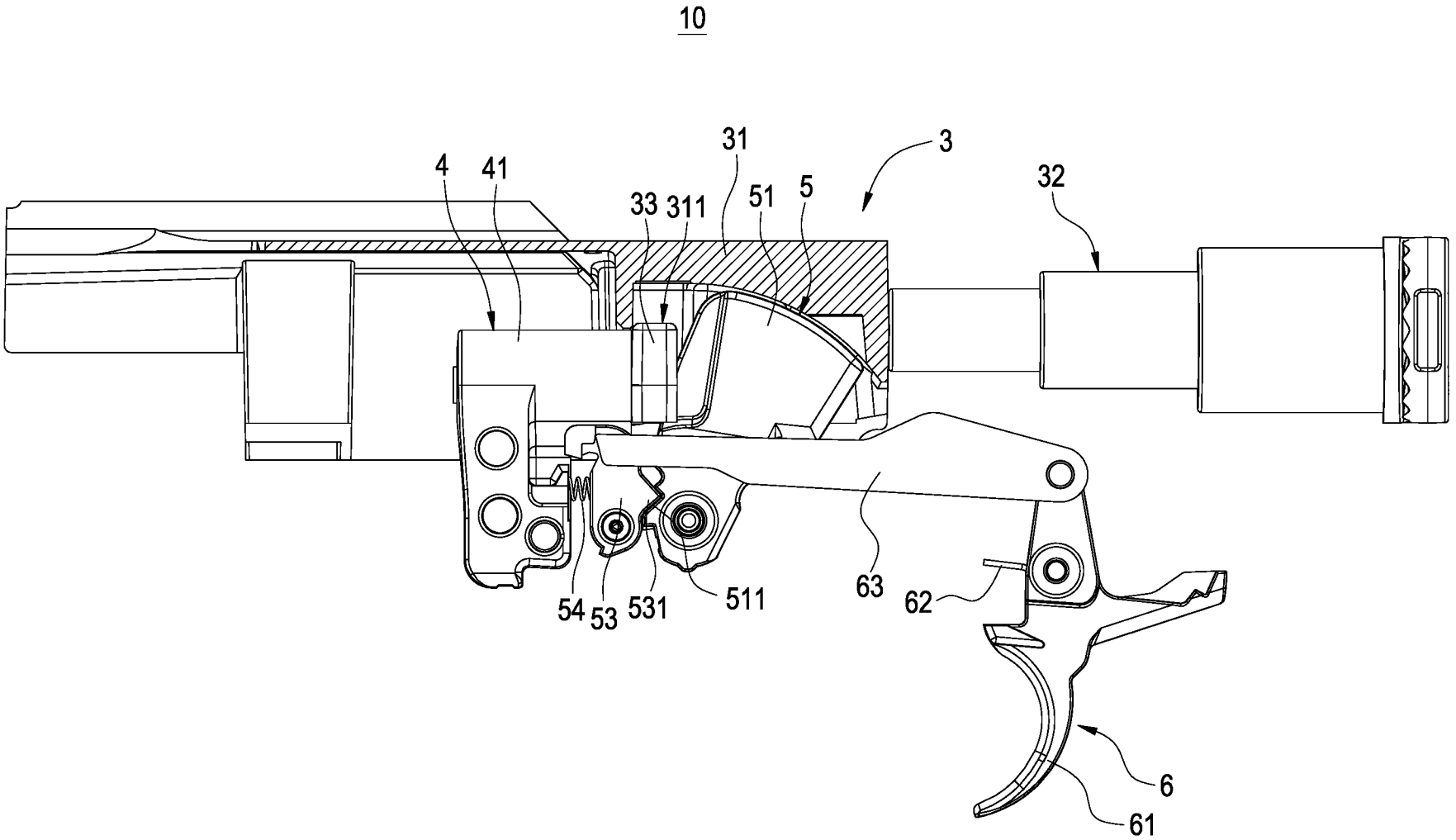
FIG. 5 is a second state of use view of the toy gun of the present invention.

Please refer to FIG. 1, FIG. 4 to FIG. 16, showing different states of use views of the toy gun 10 of the present invention. The following provides detailed description of the steps thereof. First, as shown in FIG. 1, FIG. 4 to FIG. 5, the restoring spring assembly 32 drives the action 31 to restore in a direction approaching the barrel 11. When the fifth restoring spring 62 drives the trigger 62 to restore in a direction toward the ready-to-fire position, the rigger linkage rod 63 is able to release the hammer latch 53, and the hammer latch 53 is driven by the third restoring spring 54 to latch the hammer 51, preventing the hammer 51 from striking the firing pin 42.

Figure 6:
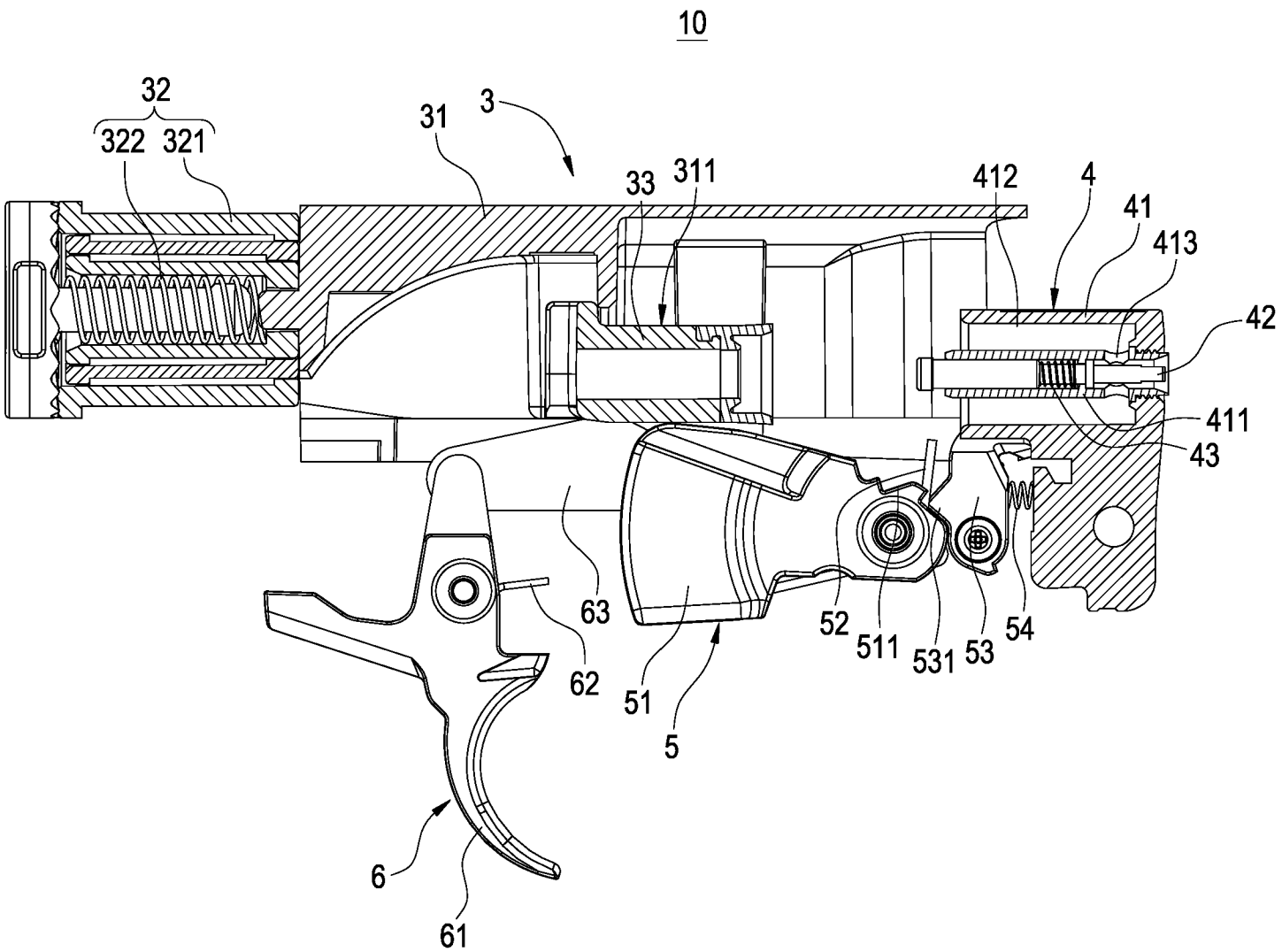
FIG. 6 is a third state of use view of the toy gun of the present invention.

Secondly, as shown in FIG. 1 and FIG. 6, when the user pulls the action 31 in a direction away from the barrel 11, since the firing pin structure 4 is fixed onto the gun body 1 without movement, the hollow piston 33 is able to move along with the action 31 in order to disengage from the ring slot 412 of the piston seat 41 and presses the hammer 51, thereby causing the hammer 51 to be in a rearward tilting state. At the same time, the first protrusion 531 of the hammer latch 53 is able to disengage from the notch 511 of the hammer 51, and the third restoring spring 54 is able to drive the hammer latch 53 to restore in a direction approaching the hammer 51.

Figure 7:
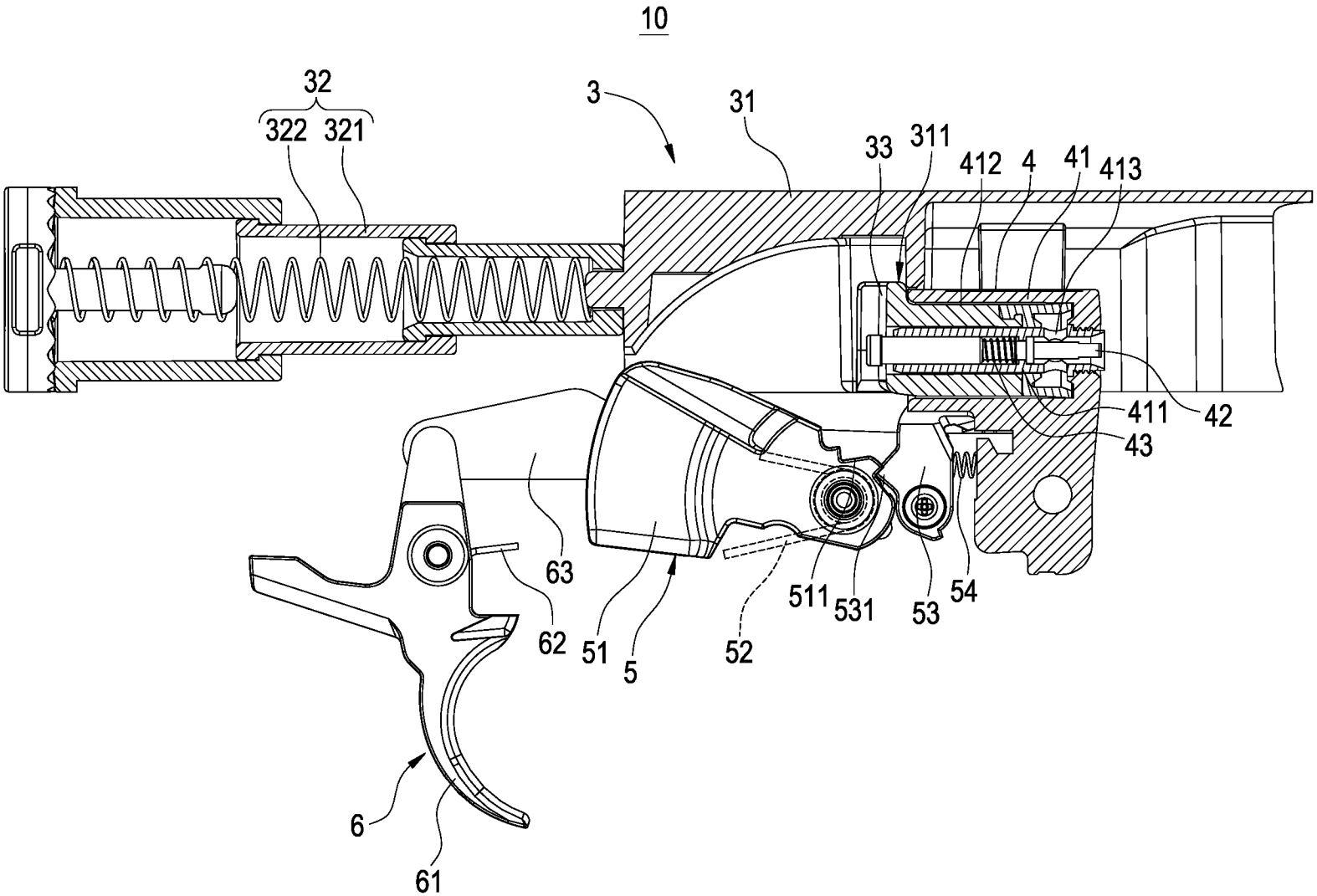
FIG. 7 is a fourth state of use view of the toy gun of the present invention.

Thirdly, as shown in FIG. 1 and FIG. 7, after the user releases the action 31, the action 31 is driven by the restoring spring assembly 32 to restore in a direction approaching the barrel 11 and releases the hammer 51. The hollow piston 33 is filled into the ring slot 412, and a rear end of the firing pin 42 is exposed at the external of the hollow piston 33. At the same time, the second restoring spring 52 is able to drive the hammer 51 to restore in a direction toward a position for striking the firing pin 42. However, the first protrusion 531 of the hammer latch 53 engages with the notch 511 of the hammer 51 such that the hammer 51 is locked by the hammer latch 53 in order to continue to maintain at the rearward tiling state. Consequently, during this time, the hammer 51 still cannot strike the firing pin 42.

Figure 8:
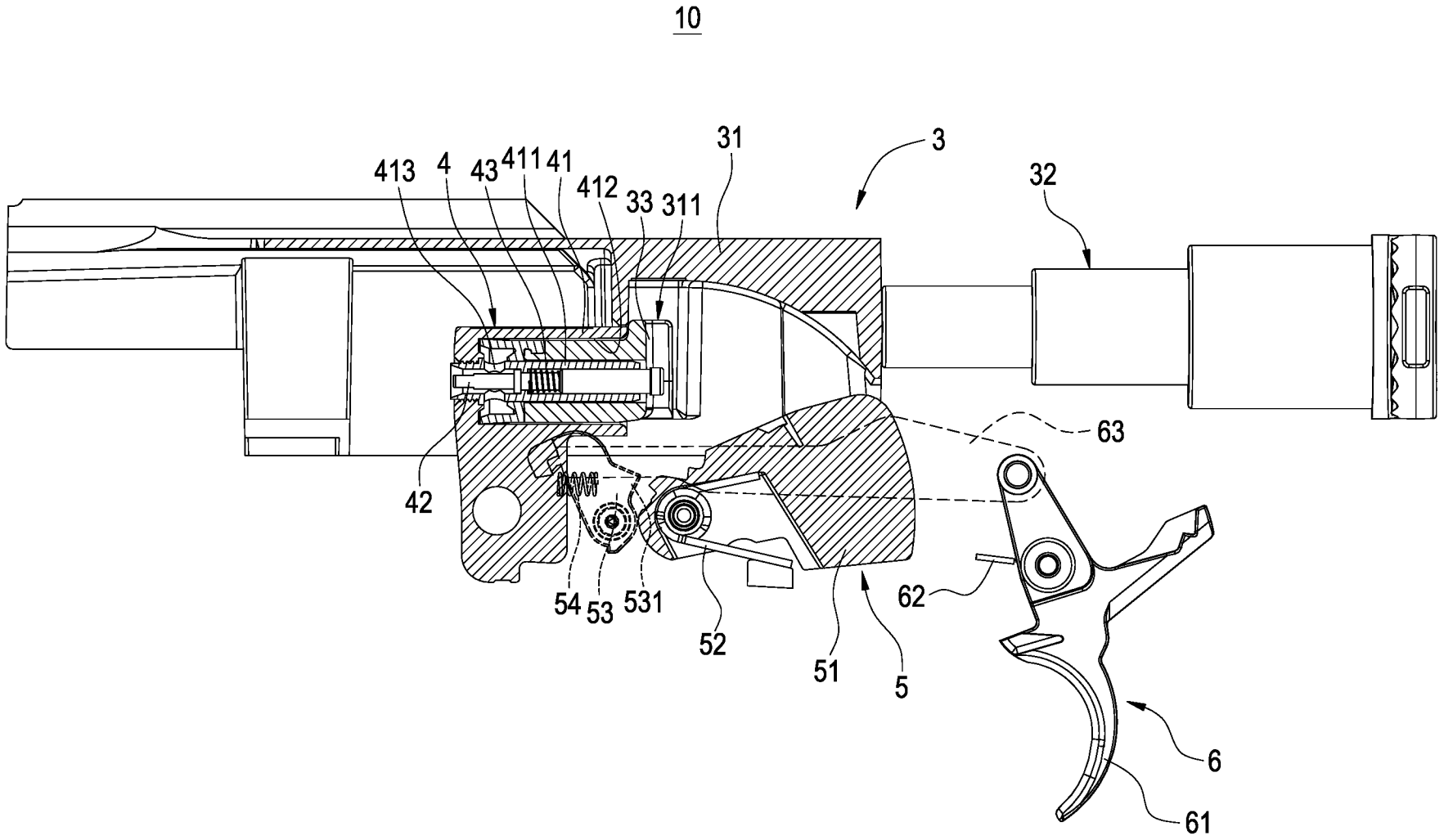
FIG. 8 is a fifth state of use view of the toy gun of the present invention.
Figure 9:
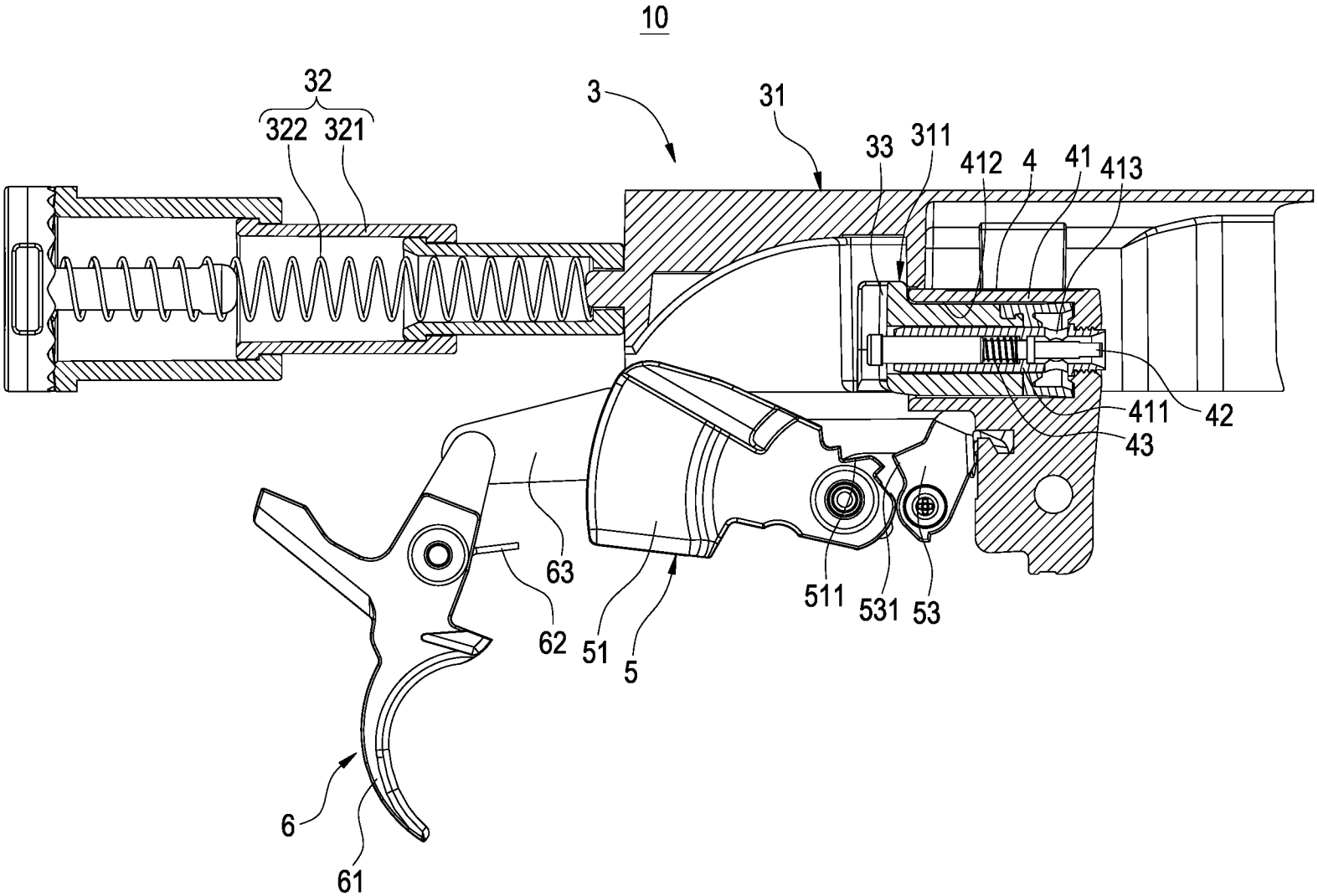
FIG. 9 is a sixth state of use view of the toy gun of the present invention.

Fourthly, as shown in FIG. 8 to FIG. 9, when the user dials the trigger 61 to reach the fire-completed position, the trigger 61 is able to drive the trigger linkage rod 63 to press the hammer latch 53 in order to allow the hammer latch 53 to release the hammer 51, thereby causing the second restoring spring 52 to drive the hammer 51 to restore in a direction toward a position for striking the firing pin 42 again.

Figure 10:
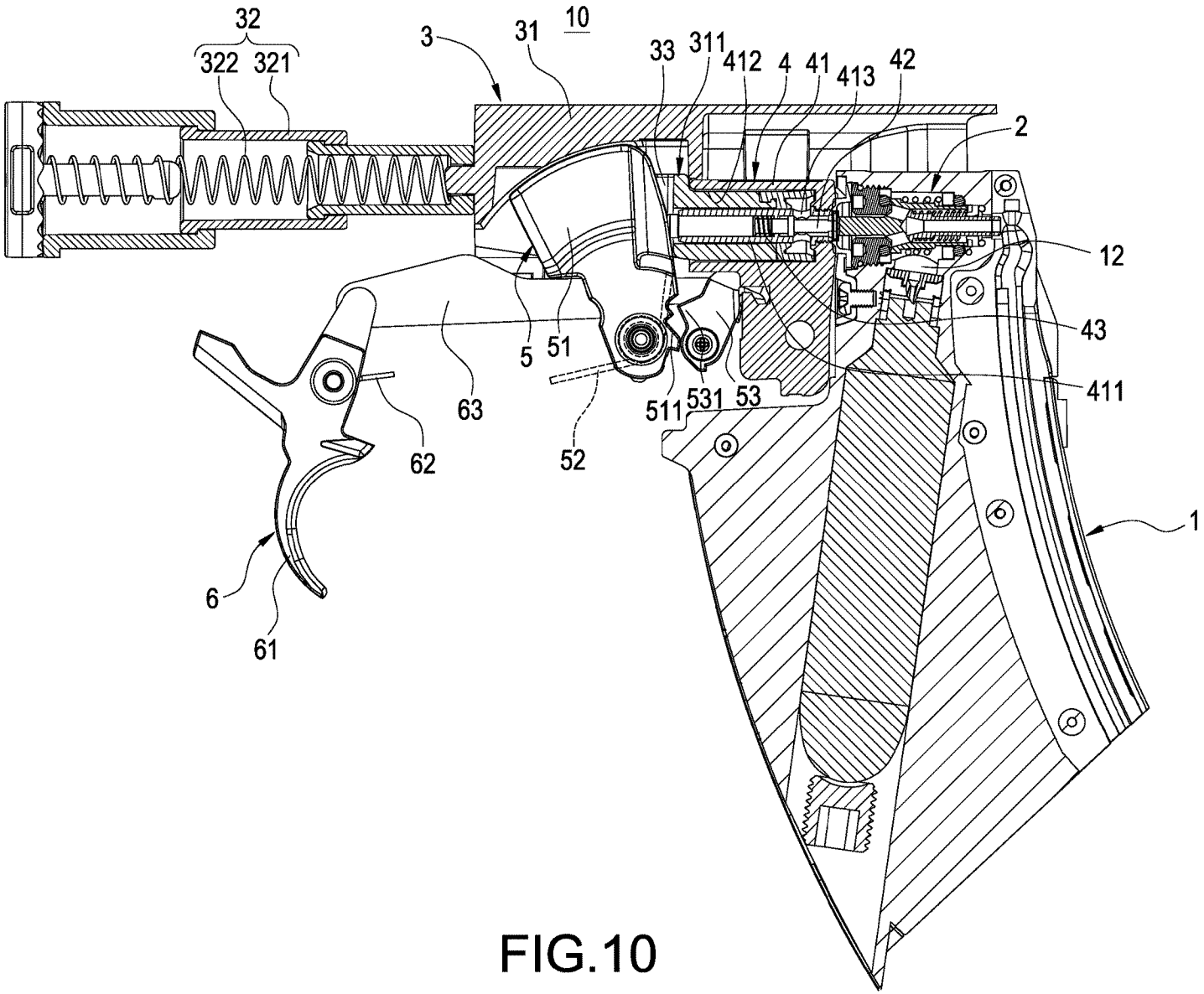
FIG. 10 is a seventh state of use view of the toy gun of the present invention.

Fifthly, as shown in FIG. 1 and FIG. 10, the hammer 51 is driven by the second restoring spring 52 to strike the firing pin 42 in order to further drive the firing pin 42 to press the switch valve 2. When the switch valve 2 is pressed, the switch valve 2 is able to control the barrel 11 to be connected to the pneumatic conduit 12, and the gas in the pneumatic conduit 12 is able to flow into the barrel 11, thereby pushing the bullet (not shown in the drawings) out of the barrel 11 and completing the first firing of shot.

Figure 11:
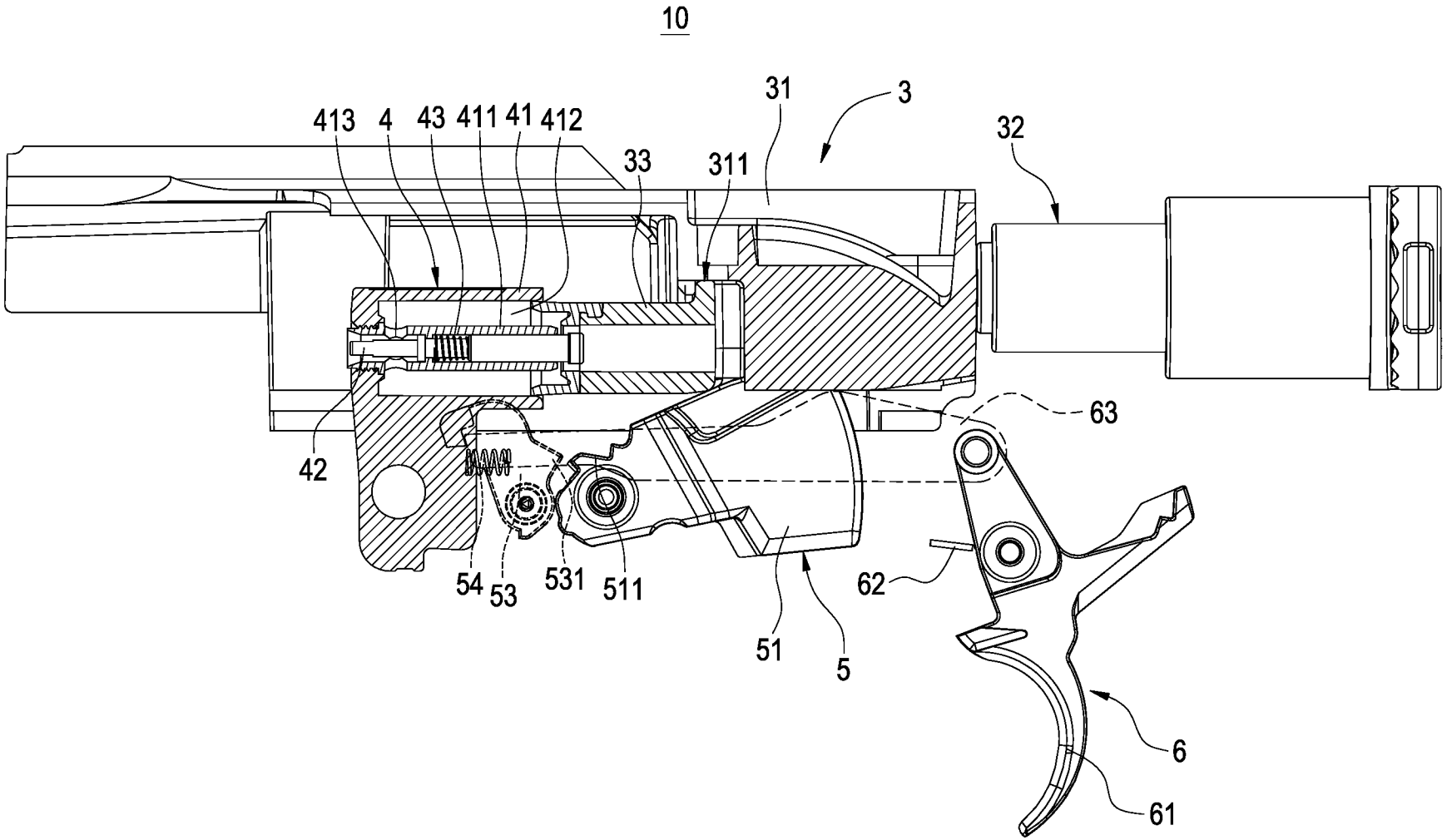
FIG. 11 is an eighth state of use view of the toy gun of the present invention.
Figure 12:
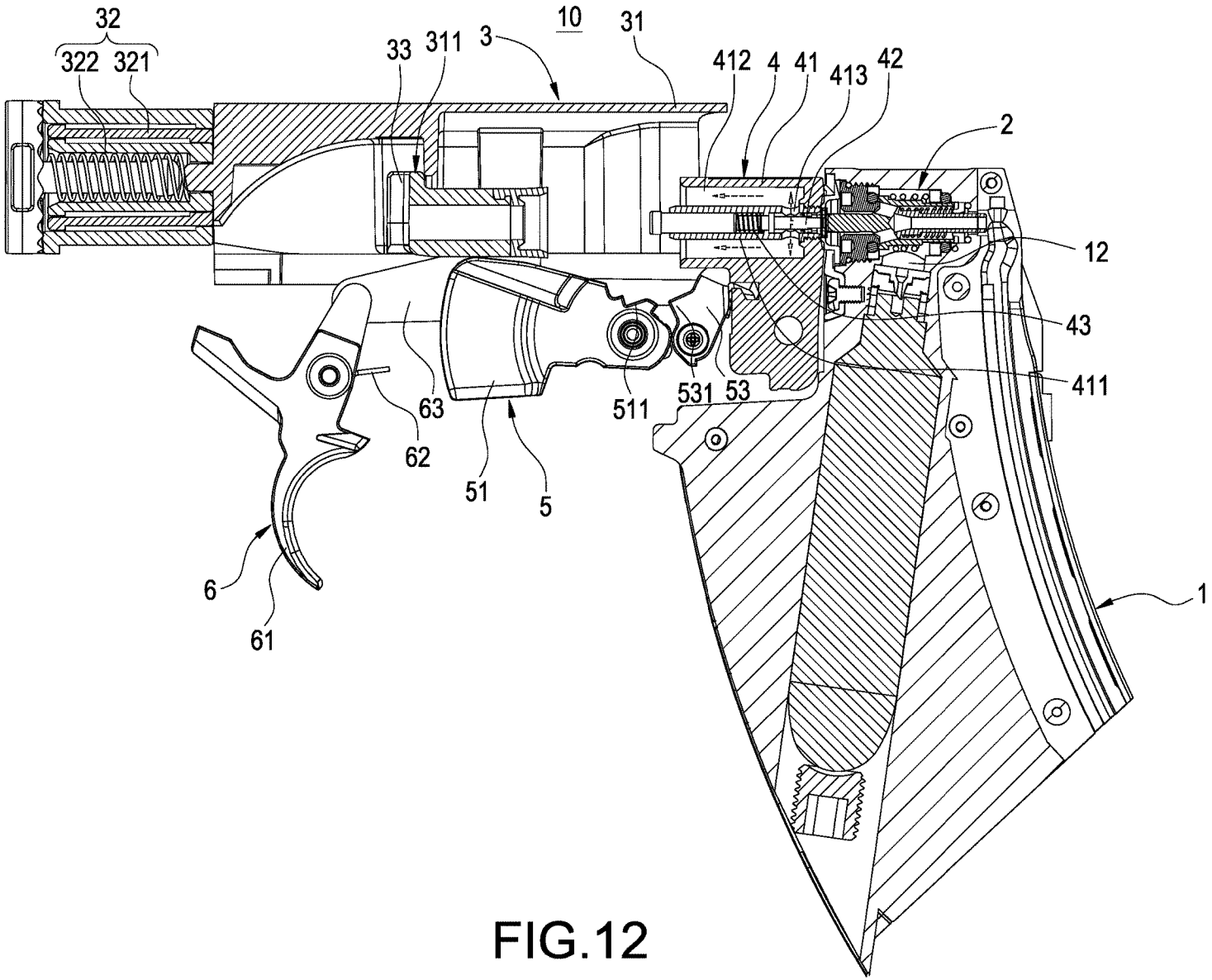
FIG. 12 is a ninth state of use view of the toy gun of the present invention.

Sixthly, as shown in FIG. 11 to FIG. 12, when the user dials the trigger 61 to reach the fire-completed position, the trigger linkage rod 63 is driven to constantly press the hammer latch 53 in order to allow the hammer latch 53 to continuously release the hammer 51. At the same time, a portion of the gas in the pneumatic conduit 12 is able to flow into the ring slot 412 via the ventilation holes 413 of the sleeve 41, such that the hollow piston 33 is pushed by the gas to disengage from the ring slot 412 and to press the hammer 51.

Figure 13:
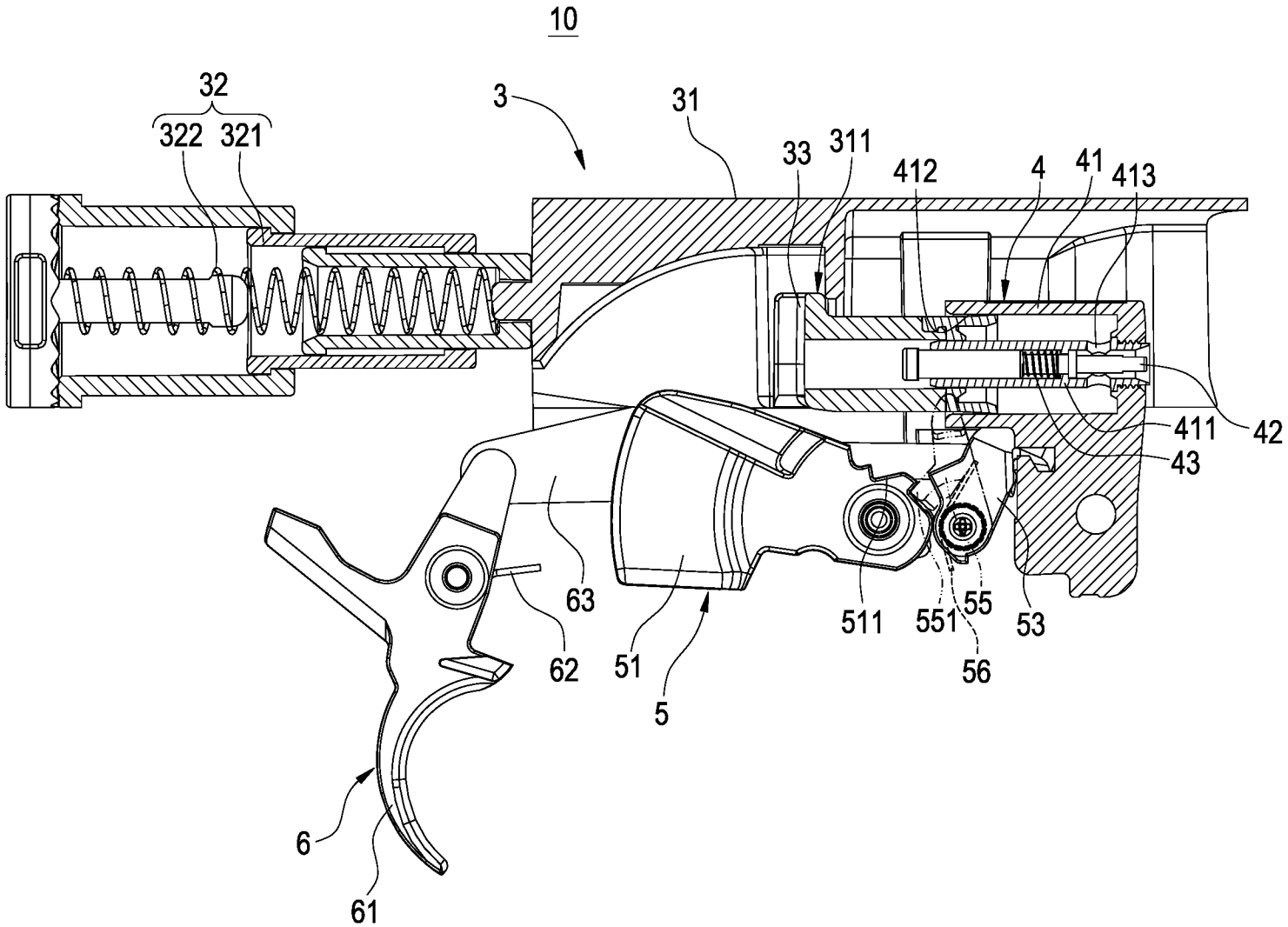
FIG. 13 is a tenth state of use view of the toy gun of the present invention.

Seventhly, as shown in FIG. 13, when the hollow piston 33 presses the hammer 51, the fourth restoring spring 56 is able to drive the running fire latch 55 to restore in a direction toward a position for latching the hammer 51 in order to allow the second protrusion 551 of the running fire latch 55 to engage with the notch 511 of the latch 51, such that the hammer 51 is locked by the running fire latch 55 to be in the rearward tilting state.

Figure 14:
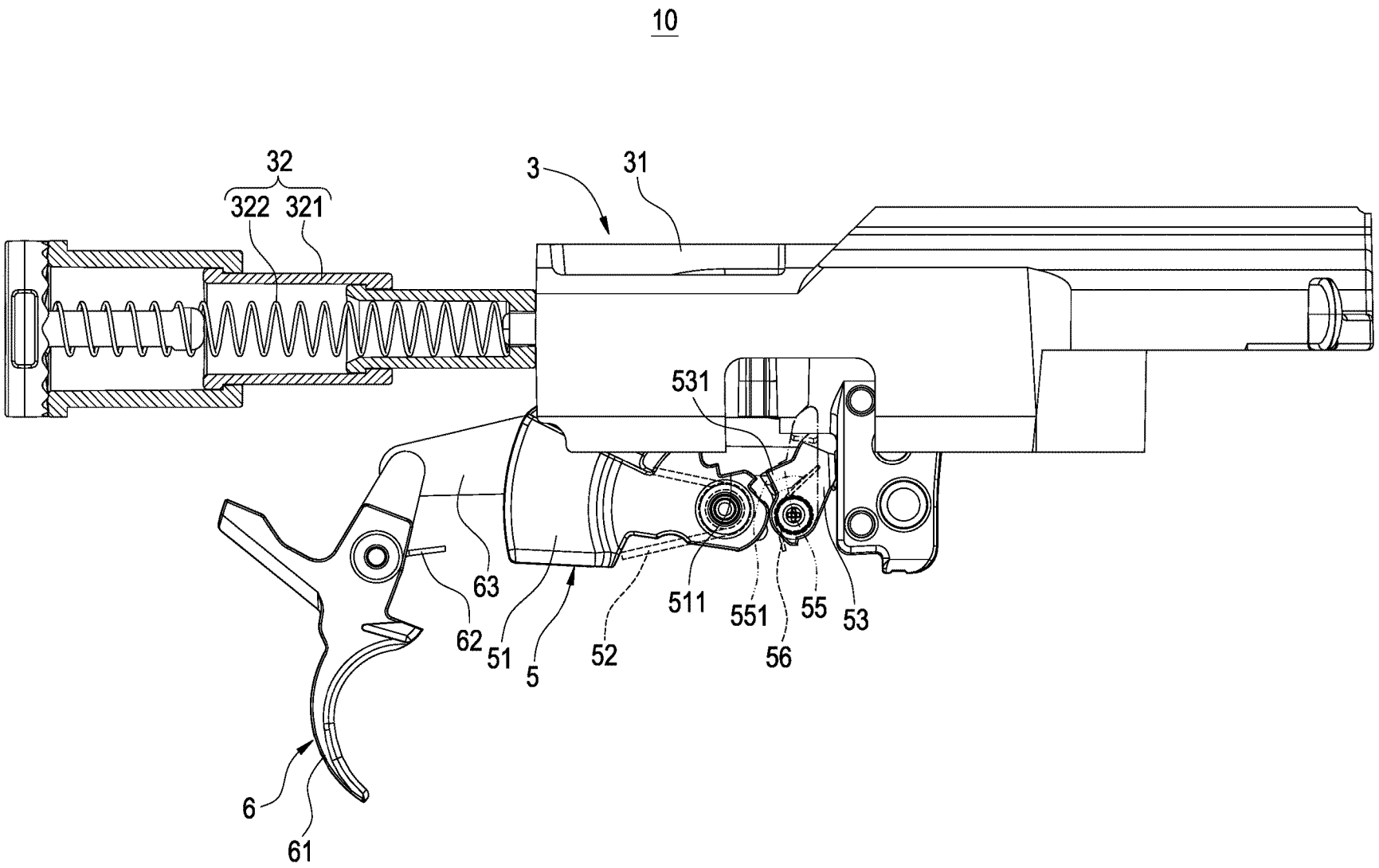
FIG. 14 is an eleventh state of use view of the toy gun of the present invention.
Figure 15:
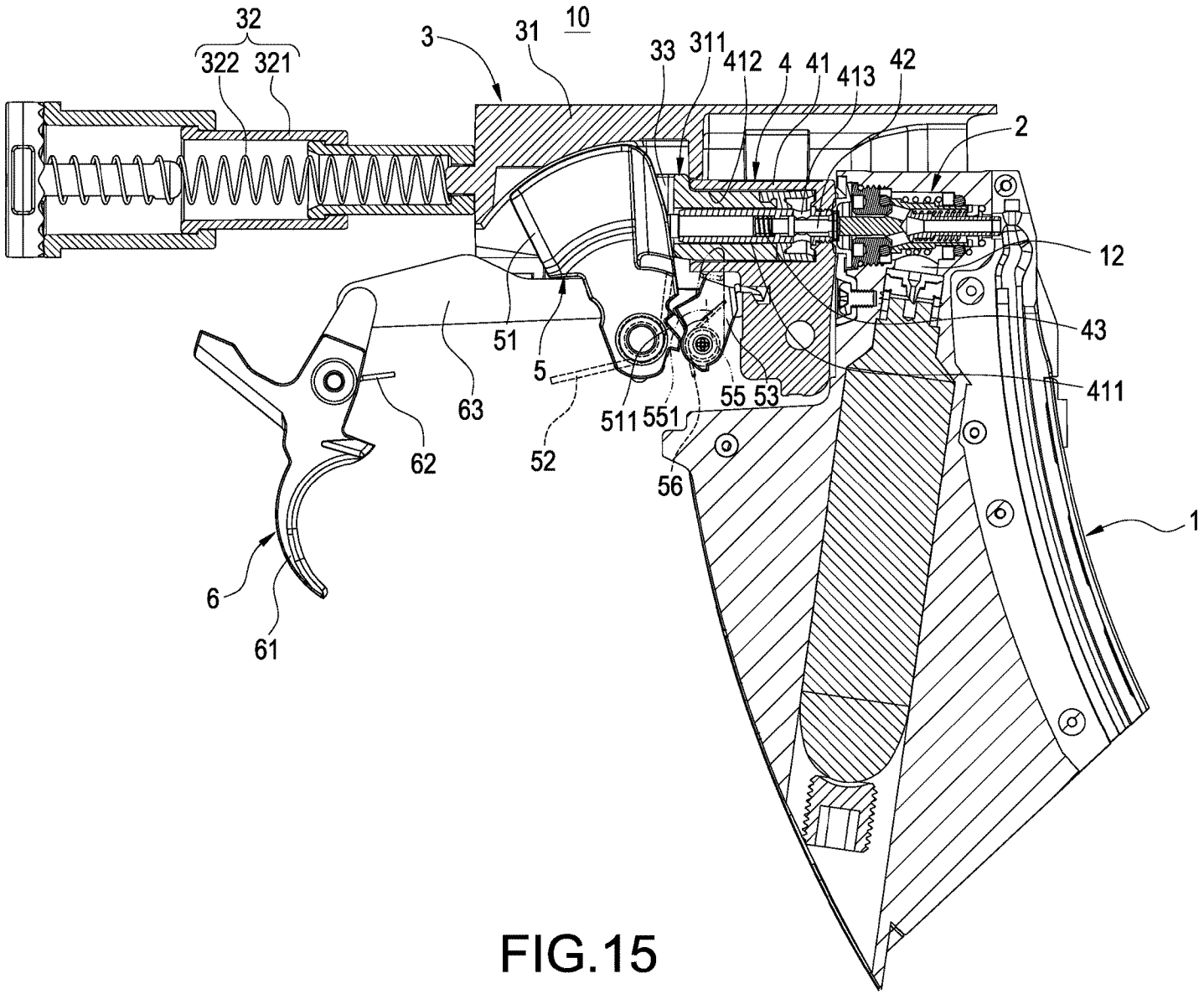
FIG. 15 is a twelfth state of use view of the toy gun of the present invention.

Eighthly, as shown in FIG. 1, FIG. 14 to FIG. 15, when the action 31 is driven by the restoring spring assembly 32 to restore in a direction approaching the barrel 11, the hollow piston 33 is able to fill into the ring slot 412, and the rear end of the firing pin 42 is exposed at the external of the hollow piston 33. In addition, the action 31 is able to press the running fire latch 55 in order to allow the running fire latch 55 to release the hammer 51, and allowing the hammer 51 to be driven by the second restoring spring 52 to strike the firing pin 42, thereby further driving the firing pin 42 to press the switch valve 2. The gas in the pneumatic conduit 12 is then released to flow into the barrel 11 in order to push the bullet (not shown in the drawings) out of the barrel 11 and completing the running fire shot.

Figure 16:
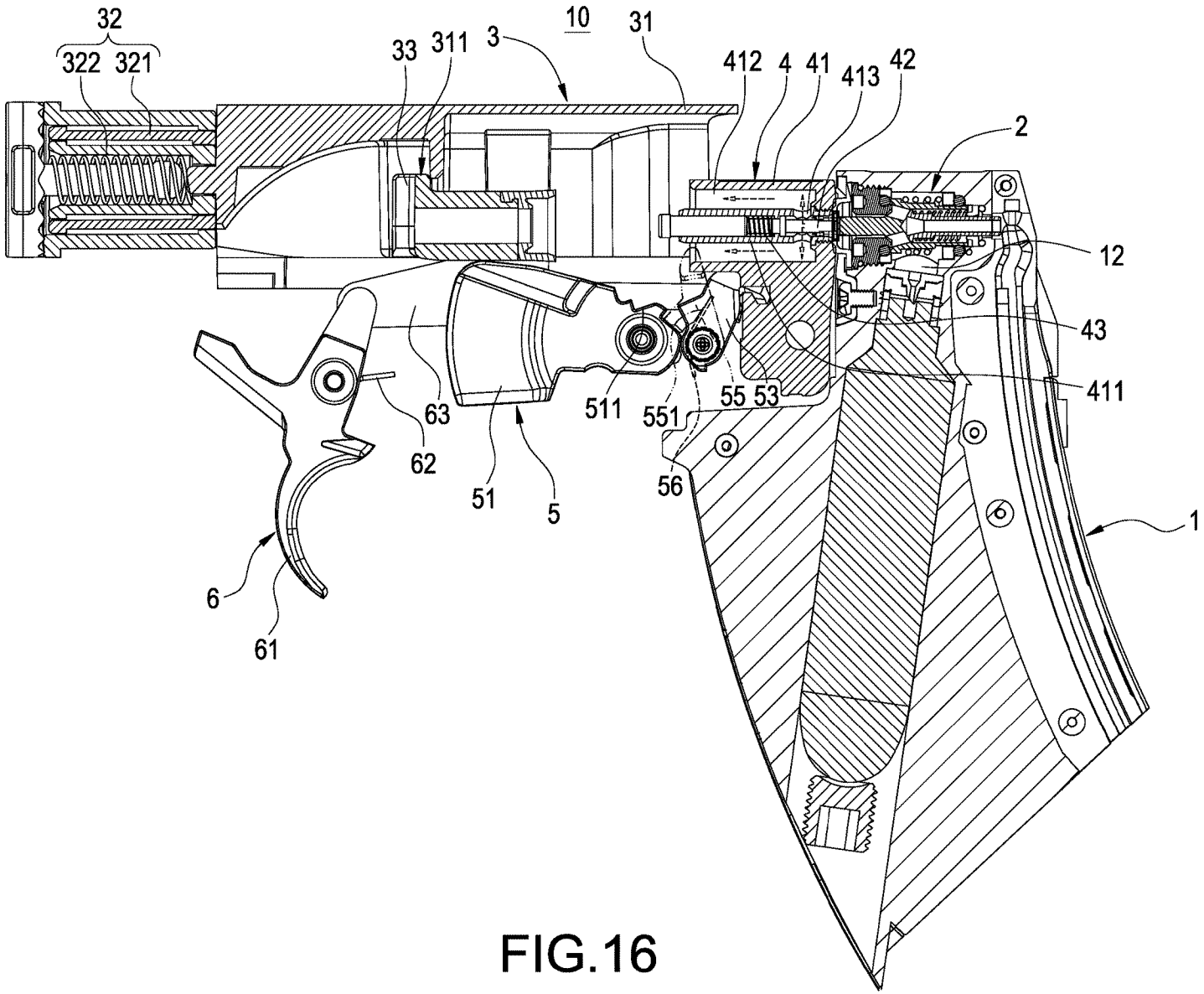
FIG. 16 is a thirteenth state of use view of the toy gun of the present invention.

Ninthly, as shown in FIG. 16, a portion of the gas in the pneumatic conduit 12 further flows into the ring slot 412 via the ventilation holes 413 of the sleeve 411 in order to push the hollow piston 33 to disengage from the ring slot 412 and to press the hammer 51. At the same time, the running fire latch 55 is driven by the fourth restoring spring 56 to latch the hammer 51.

Finally, the steps shown in FIG. 11 to FIG. 16 are repeated, and the hammer 51 is able to perform striking continuously until the gas inside the gas cylinder 100 is used up completely.

For a known firing pin structure, it is fixed onto the action and moves along with the action horizontally. However, during the restoration of the action, the action tends to fail to drive the firing pin structure to the predefined striking position due to possible spring fatigue, causing interruption of the running fire shots.

In comparison to the prior art, in the present invention, the firing pin structure is fixed onto the gun body 1 such that it is able to prevent the situation where the firing pin structure 4 fails to reach the predefined position, and the piston member 311 is required to fill into the piston seat 41 such that the rear end of the firing pin 42 is exposed at the external of the hollow piston 33 in order to perform firing of shots. Consequently, the toy gun 10 of the present invention has the merits of smooth continuous firing and high safety of use.

Furthermore, when the piston member 311 moves in a direction approaching the piston seat 41 and is located between the piston seat 41 and the hammer 51, the action 31 can then press the running fire latch 55 in order to allow the running fire latch 55 to release the hammer 51. Consequently, when the second restoring spring 52 drives the hammer 51 to restore each time, it is able to properly strike the firing pin 42, such that the smoothness of the continuous firing hots of the toy gun 10 of the present invention is enhanced.

In view of the above, the present invention of the toy gun with a fixed firing pin structure mechanism is able to achieve the expected objectives of use and to overcome the drawbacks of the prior arts. Therefore, the present invention is of novelty and inventive step, complying with the patentability for an invention patent. Accordingly, patent application is hereby filed according to the law in light of the grant of the patent right for the protection of the rights of the inventor.

What is claimed is:

1. A toy gun with a fixed firing pin structure mechanism, comprising:

a gun body (1) having a barrel (11) and a pneumatic conduit (12) connected to the barrel (11);

a switch valve (2) installed between the barrel (11) and the pneumatic conduit (12);

an action assembly (3) installed on the barrel (1); the action assembly (3) comprising an action (31) configured to move forward and backward horizontally relative to the gun body (1), a restoring spring assembly (32) elastically supported between the gun body (1) and the action (31); the restoring spring assembly (32) configured to drive the action (31) to restore in a direction approaching the barrel (11); the action (31) having a piston member (311); and a firing pin structure (4) fixed onto the gun body (1) and arranged between the switch valve (2) and the piston member (311); the firing pin structure (4) comprising a piston seat (41) and a firing pin (42) penetrating into the piston seat (41) and configured to move forward and backward horizontally relative to the switch valve (2); the piston member (311) configured to fill into or disengage from the piston seat (41), wherein the piston member (311) is a hollow piston (33) fixed on the action (31), the piston seat (41) includes a sleeve (411) and a ring slot (412) surrounding a perimeter of the sleeve (411), the hollow piston (33) is configured to fill into or disengage from the ring slot (412), and when the hollow piston (33) is filled into the ring slot (412), a rear end of the firing pin (42) is exposed at an external of the hollow piston (33).

2. The toy gun with a fixed firing pin structure mechanism according to claim 1, wherein the firing pin structure (4) further comprises a first restoring spring (43); the piston seat (41) is fixed onto the gun body (1); the sleeve (411) includes at least one ventilation hole (413) connected to the ring slot (412); the firing pin (42) penetrates into the sleeve (411) and is configured to move forward and backward horizontally relative to the sleeve (411); the first restoring spring (43) is elastically supported between the sleeve (411) and the firing pin (42) and configured to drive the firing pin (42) to restore in a direction away from the switch valve (2).

3. The toy gun with a fixed firing pin structure mechanism according to claim 1, wherein the restoring spring assembly (32) comprises a plurality of shell housings (321) installed between the gun body (1) and the action (31) and configured to penetrate through each other and a helical spring (322) received at an internal of the plurality of shell housings (321).

4. The toy gun with a fixed firing pin structure mechanism according to claim 1, further comprising a hammer assembly (5); wherein the hammer assembly (5) comprises a hammer (51) pivotally attached onto the gun body (1) and a second restoring spring (52) elastically supported between the gun body (1) and the hammer (51); the second restoring spring (52) is configured to drive the hammer (51) to restore in a direction toward a position for striking the firing pin (42); when the hammer (51) strikes the firing pin (42), the firing pin (42) is driven to press the switch valve (2).

5. The toy gun with a fixed firing pin structure mechanism according to claim 4, wherein the hammer assembly (5) further comprises a running fire latch (55) pivotally attached onto the gun body (1) and a fourth restoring spring (56) elastically supported between the gun body (1) and the running fire latch (55); the fourth restoring spring (56) is configured to drive the running fire latch (55) to restore in a direction toward a position for latching the hammer (51).

6. The toy gun with a fixed firing pin structure mechanism according to claim 5, wherein when the piston member (311) moves in a direction toward the piston seat (41) and is located between the piston seat (41) and the hammer (51), the action (31) is able to press the running fire latch (55) in order to allow the running fire latch (55) to release the hammer (51).

7. The toy gun with a fixed firing pin structure mechanism according to claim 6, wherein the hammer assembly (5) further comprises a hammer latch (53) pivotally attached onto the gun body (1) and a third restoring spring (54) elastically supported between the gun body (1) and the hammer latch (53); the third restoring spring (54) is configured to drive the hammer latch (53) to restore in a direction approaching the hammer (51).

8. The toy gun with a fixed firing pin structure mechanism according to claim 7, wherein the hammer latch (53) and the running fire latch (55) are pivotally attached onto the gun body (1) in a left and right parallel arrangement method; the hammer latch (53) includes a first protrusion (531); the running fire latch (55) includes a second protrusion (551); the hammer (51) includes a notch (511); the first protrusion (531) and the second protrusion (551) are configured to engage with or disengage from the notch (511).

9. The toy gun with a fixed firing pin structure mechanism according to claim 7, further comprising a trigger assembly (6); wherein the trigger assembly (6) is configured to press or release the hammer latch (53); when the trigger assembly (6) presses the hammer latch (53), the hammer latch (53) is driven to release the hammer (51).

10. The toy gun with a fixed firing pin structure mechanism according to claim 9, wherein the trigger assembly (6) comprises a trigger (61) pivotally attached onto the gun body (1) and a fifth restoring spring (62) elastically supported between the gun body (1) and the trigger (61); the trigger (61) is configured to move between a ready-to-fire position and a fire-completed position; the fifth restoring spring (62) is configured to drive the trigger (61) to restore in a direction toward the ready-to-fire position.

11. The toy gun with a fixed firing pin structure mechanism according to claim 10, wherein the trigger assembly (6) further comprises a trigger linkage rod (63) pivotally attached onto the trigger (61); the trigger linkage rod (63) is configured to press or release the hammer latch (53); when the trigger (61) is at the fire-completed position, the trigger linkage rod (63) is driven to press the hammer latch (53) in order to allow the hammer latch (53) to release the hammer (51).

* * * * *